US008284104B2

(12) United States Patent
Carr

(10) Patent No.: US 8,284,104 B2
(45) Date of Patent: Oct. 9, 2012

(54) MULTIPLE-RESONATOR ANTENNA

(76) Inventor: William N. Carr, Montclair, NJ (US)

( * ) Notice: Subject to any disclaimer, the term of this patent is extended or adjusted under 35 U.S.C. 154(b) by 537 days.

(21) Appl. No.: 12/535,768

(22) Filed: Aug. 5, 2009

(65) Prior Publication Data

US 2010/0207841 A1 Aug. 19, 2010

Related U.S. Application Data

(60) Provisional application No. 61/207,467, filed on Feb. 13, 2009, provisional application No. 61/207,909, filed on Feb. 19, 2009, provisional application No. 61/214,200, filed on Apr. 22, 2009.

(51) Int. Cl.
*H01Q 1/38* (2006.01)
*H01Q 9/00* (2006.01)
*H01Q 9/04* (2006.01)

(52) U.S. Cl. ..... 343/700 MS; 343/749; 343/825

(58) Field of Classification Search ..... 343/700 MS, 343/853, 857, 858, 893, 749, 825
See application file for complete search history.

(56) References Cited

U.S. PATENT DOCUMENTS

| | | | | |
|---|---|---|---|---|
| 4,128,840 | A | 12/1978 | Tucker | |
| 4,259,670 | A | 3/1981 | Schiavone | |
| 4,356,492 | A * | 10/1982 | Kaloi | 343/700 MS |
| 4,704,581 | A | 11/1987 | Clark | |
| 4,783,661 | A * | 11/1988 | Smith | 343/700 MS |
| 5,283,589 | A | 2/1994 | Blevins | |
| 5,341,148 | A | 8/1994 | Walter et al. | |
| 5,471,180 | A | 11/1995 | Brommer et al. | |
| 5,995,048 | A | 11/1999 | Smithgall et al. | |
| 6,342,864 | B1 | 1/2002 | Muramoto et al. | |
| 6,552,693 | B1 | 4/2003 | Leisten | |
| 6,975,276 | B2 | 12/2005 | Brown | |
| 7,019,711 | B2 | 3/2006 | Johnson et al. | |
| 7,034,752 | B2 | 4/2006 | Sekiguchi et al. | |
| 7,088,290 | B2 | 8/2006 | Ohno et al. | |
| 7,173,577 | B2 | 2/2007 | Brown et al. | |
| 7,388,550 | B2 | 6/2008 | McLean | |
| 7,471,247 | B2 | 12/2008 | Saily et al. | |

(Continued)

FOREIGN PATENT DOCUMENTS

WO 2004093249 A1 10/2004

OTHER PUBLICATIONS

Young, Lee W., "PCT Application No. PCT/US 10/00441 International Search Report Apr. 7, 2010", , Publisher: PCT, Published in: PCT.

(Continued)

*Primary Examiner* — Jacob Y Choi
*Assistant Examiner* — Hasan Islam
(74) *Attorney, Agent, or Firm* — Kaplan Breyer Schwarz & Ottesen LLP

(57) ABSTRACT

A Radio-Frequency IDentification (RFID) receiver is disclosed that comprises a plurality of resonant structures arranged to form an antenna. The resonant structures are interconnected in series and are arranged, relative to one another, so as to achieve a received electrical signal with an increased voltage, when the antenna is exposed to an incident electromagnetic signal. This occurs for a majority of all possible incident electromagnetic signals and, therefore, an RFID receiver based on such an antenna provides, in a majority of cases, an improved performance.

16 Claims, 4 Drawing Sheets

Multiple-resonator antenna with load element 800

U.S. PATENT DOCUMENTS

| | | | | |
|---|---|---|---|---|
| 7,589,678 | B2 | 9/2009 | Perunka et al. | |
| 7,619,570 | B1 * | 11/2009 | Sarehraz et al. | 343/700 MS |
| 2002/0057222 | A1 | 5/2002 | McKinzie, III et al. | |
| 2002/0167282 | A1 | 11/2002 | Kirkpatrick et al. | |
| 2003/0058178 | A1 | 3/2003 | Von Alpen et al. | |
| 2003/0169204 | A1 | 9/2003 | Saito | |
| 2003/0201942 | A1 | 10/2003 | Poilasne et al. | |
| 2003/0210190 | A1 | 11/2003 | Lai | |
| 2004/0021605 | A1 | 2/2004 | Kouam et al. | |
| 2004/0070541 | A1 | 4/2004 | Andersson et al. | |
| 2005/0057415 | A1 | 3/2005 | Rawnick et al. | |
| 2006/0181475 | A1 | 8/2006 | Kwon et al. | |
| 2007/0109201 | A1 | 5/2007 | Licul et al. | |
| 2007/0210976 | A1 | 9/2007 | Luk et al. | |
| 2007/0290941 | A1 | 12/2007 | Brown et al. | |
| 2008/0122631 | A1 | 5/2008 | Kodukula et al. | |
| 2008/0191950 | A1 | 8/2008 | Chang et al. | |
| 2008/0284656 | A1 | 11/2008 | Petropoulos | |
| 2010/0013718 | A1 | 1/2010 | Zhu et al. | |
| 2010/0207840 | A1 | 8/2010 | Carr | |
| 2010/0207841 | A1 | 8/2010 | Carr | |

OTHER PUBLICATIONS

Young, Lee W., "PCT Application No. PCT/US 10/00424 International Search Report Apr. 9, 2010", , Publisher: PCT, Published in: PCT.

Dinh, Trinh Vo, "U.S. Appl. No. 12/621,451 Office Action May 10, 2012", , Publisher: USPTO, Published in: US.

Carr, William N., "U.S. Appl. No. 12/462,428, filed Aug. 5, 2009", , Publisher: USPTO, Published in: US.

Athina Nickitas-Etienne, "PCT Application No. PCT/US2010/000441 International Preliminary Report on Patentability", , Publisher: PCT, Published in: PCT.

Beate Giffo-Schmitt, "PCT Application No. PCT/US2010/000424 International Preliminary Report on Patentability", , Publisher: PCT, Published in: PCT.

* cited by examiner

Monopole antenna 100 resonant structure 200

Folded-dipole antenna 300

Antenna with load element 400

Dual-resonator antenna with load element 500

Dual-resonator antenna with dielectric 600

Multiple-resonator antenna 700

Multiple-resonator antenna with load element 800

MULTIPLE-RESONATOR ANTENNA

FIELD OF THE INVENTION

The present invention relates to antenna design for radio communication in general, and, more particularly, to antenna design for Radio-Frequency IDentification (RFID) systems.

BACKGROUND OF THE INVENTION

Radio communication systems have existed for over a century. During this period of time, antenna designers have generated a wide variety of designs with the goal of achieving good performance in a variety of operating conditions.

Generally, the goal of the antenna designer when designing, for example, a receiving antenna, is to maximize power transfer between an electromagnetic signal incident on the antenna, and the resulting electrical signal generated by the antenna. The higher the power transfer, the higher the received signal-to-noise ratio, which usually results in better receiver performance.

Also, traditionally, radio receivers have comprised an electronic assembly and a separate receiving antenna interconnected to one another through a suitable cable connection. In such systems, antenna designers must consider the distorting influence of the cable connection and the electronic assembly on the electromagnetic behavior of the antenna.

More recently, with the advent of small radio systems based in integrated circuit technology, it has become possible to make so-called Radio-Frequency IDentification (RFID) systems, wherein an entire radio receiver is housed in a package much smaller than the receiving antenna. In such systems, the absence of the distorting influence of the cable connection and the electronic assembly enables novel antenna designs.

So-called passive RFID receivers can be much smaller than the receiving antenna in part because they do not require a power supply. Power to operate the receiver is derived from the received radio signal itself. The signal generated by the receiving antenna is rectified by one or more diodes to yield a direct-current (DC) voltage that is used to power the receiver.

Ideal diodes are perfect conductors when a forward voltage is applied and are perfect insulators when a reverse voltage is applied. Real diodes only approximate this behavior. In particular, real diodes require a minimum forward voltage before becoming good conductors. Accordingly, the signal generated by the receiving antenna, must have a voltage larger than the minimum required by the diodes, before a DC voltage becomes available to power the RFID receiver.

So, in contrast with traditional antenna design, the goal for RFID-receiver antennas is to maximize not the received-signal power, but rather the received-signal voltage.

It is well known in the art that antennas are reciprocal devices, meaning that an antenna that is used as a transmitting antenna can also be used as a receiving antenna, and vice versa. Furthermore, there is a one-to-one correspondence between the behavior of an antenna used as a receiving antenna and the behavior of the same antenna used as a transmitting antenna. This property of antennas is known in the art as "reciprocity."

An antenna used as a transmitting antenna accepts an electrical signal applied at an input port and produces a transmitted electromagnetic signal that propagates through three-dimensional space. It is well known in the art how to represent such a transmitted electromagnetic signal as a vector in a vector space, for example, as a superposition of spherical harmonics. The behavior of a transmitting antenna at a given frequency can be fully characterized by reporting, for example, the spherical-harmonic components of the transmitted electromagnetic signal that it generates in response to a test electrical signal at that frequency that is applied to the antenna's input port.

Such a characterization can be used to derive, unambiguously, the behavior of the same antenna when it is used as a receiving antenna. In this case, the input port becomes an output port that generates an output electrical signal in response to an incident electromagnetic signal propagating through three-dimensional space. The incident electromagnetic signal can be specified by, for example, by specifying its spherical-harmonic components. The resulting electrical signal can then be derived through a scalar product with the spherical-harmonic components of the transmitted electromagnetic signal at the same frequency, as is well known in the art.

A consequence of reciprocity is that an antenna can be fully characterized in terms of its properties as either a transmitting antenna or as a receiving antenna. A full characterization of an antenna when used in one mode (transmitting or receiving) uniquely and unambiguously defines the properties of the antenna when used in the other mode.

For example, in order to understand or measure the radiation pattern of an antenna it is frequently easier to feed an electric signal into the antenna and then observe the electromagnetic field generated by the antenna. This task can be performed experimentally or computationally. The radiation pattern of the antenna that is obtained through this method also applies when the antenna is used as a receiving antenna. Hereinafter, antennas will be interchangeably referred to as receiving or transmitting, and their properties will be discussed as they apply to either transmission or reception, as convenient to achieve clarity. It will be clear to those skilled in the art how to apply what is said about an antenna used in one mode (receiving or transmitting) to the same antenna used in the other mode.

FIG. 1 depicts monopole antenna 100 in accordance with the prior art. Monopole antenna 100 comprises monopole 110, ground plane 120 and co-axial cable connection 130. Monopole antenna 100 is a very common type of antenna and is representative of how many antennas operate. When an electrical signal is applied to co-axial cable connection 130, an electric field appears between monopole 110 and ground plane 120. If the electrical signal has a frequency at or near the so-called "resonant" frequency of the antenna, a large fraction of the power of the electrical signal is converted into an electromagnetic signal that is radiated by the antenna. If the electrical signal has a frequency that is substantially different form the resonant frequency of the antenna, a relatively small fraction of the signal's power is radiated; most of the power is reflected back into the co-axial cable connection.

In principle, it is possible to make an antenna that radiates efficiently at many frequencies, without exhibiting a band of resonance. In practice, it is difficult to make such antennas, and resonant structures (hereinafter also referred to as "resonators") are commonly used to make antennas that radiate efficiently.

FIG. 2 depicts resonant structure 200, which is an example of a type of resonant structure commonly used to make antennas in the prior art. Resonant structure 200 comprises a length of wire 240 bent in the shape of the letter U, with an input-output port 220 comprising connection points 230-1 and 230-2. As depicted in FIG. 2, the two connection points are attached to the two ends of the wire.

The frequency of resonance of resonant structure 200 depends on its length. The structure can be modeled as a twin-lead transmission line 210 with a short at one end (i.e., the end opposite input-output port 220). The structure is resonant at a frequency for which the length of the transmission line is one quarter of a wavelength. The range of frequencies over which the resonant structure exhibits good resonance is known as the "band of resonance."

Resonant structure 200 exhibits resonance in a manner similar to monopole antenna 100. Near the resonant frequency, the electromagnetic fields generated by the voltages and currents on wire 240 become stronger, and a larger fraction of the power of an electrical signal applied to input-output port 220 is radiated as an electromagnetic signal. Accordingly, resonant structures that exhibit this behavior are referred to as "electromagnetically-resonant."

FIG. 3 depicts folded-dipole antenna 300, which is an example of a common type of antenna in the prior art. Folded-dipole antenna 300 can be modeled as being composed of two instances of resonant structure 200 connected in series. When used as a transmitting antenna, an electrical signal is applied through balanced transmission line 320.

Although folded-dipole antenna 300 can be modeled as being composed of two instances of resonant structure 200 connected in series, the signal that it generates when used as a receiving antenna is not the sum of the signals that each instance of resonant structure 200 would generate if used by itself because of the mutual coupling between the two instances of resonant structure 200.

FIG. 4 depicts antenna with load element 400, which is an example of a type of antenna in the prior art for RFID tags. Antenna with load element 400 comprises: conductive sheets 410-1, and 410-2, electrical connection 420, connection points 440-1 and 440-2, and load element 430, interrelated as shown.

Conductive sheets 410-1 and 410-2, together with electrical connection 420, form resonant structure 450. Load element 430 receives the signal generated by resonant structure 450 through connection points 440-1 and 440-2. When used to implement an RFID tag, load element 430 is small relatively to the size of conductive sheets 410-1 and 410-2.

SUMMARY OF THE INVENTION

Embodiments of the present invention comprise a plurality of resonant structures arranged to form an antenna. An antenna in accordance with the present invention comprises multiple resonant structures interconnected in series and arranged, relative to one another, so as to achieve a received electrical signal with an increased voltage. In particular, when exposed to an incident electromagnetic signal, an antenna in accordance with the present invention generates a received electrical signal whose voltage amplitude (hereinafter "amplitude") is larger than the amplitude of the electrical signals generated by the individual resonant structures comprised by the antenna. This occurs for a majority of all possible incident electromagnetic signals and, therefore, an RFID receiver based on such an antenna provides, in a majority of cases, an improved performance.

DETAILED DESCRIPTION

Figure 1:
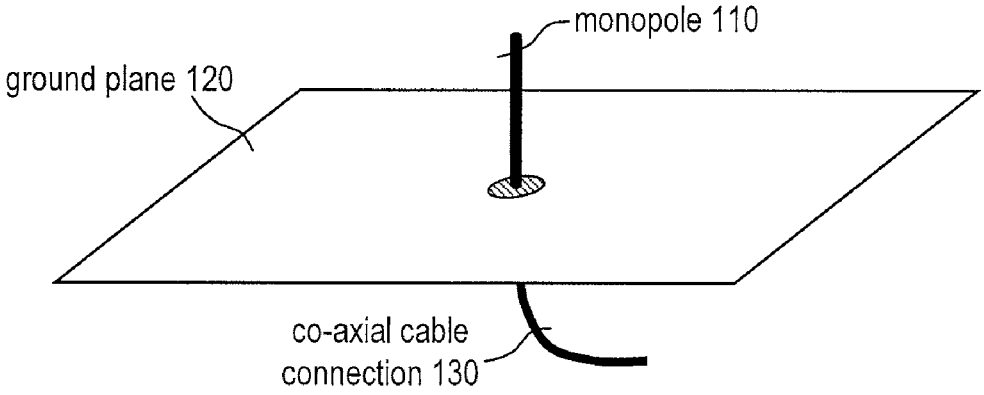
FIG. 1 PRIOR ART
FIG. 1 depicts a monopole antenna in the prior art.
Figure 2:
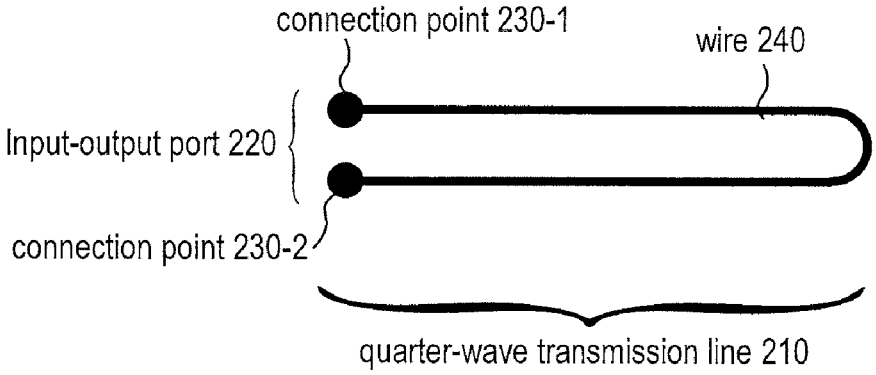
FIG. 2 PRIOR ART
FIG. 2 depicts a resonant structure in the prior art.
Figure 3:
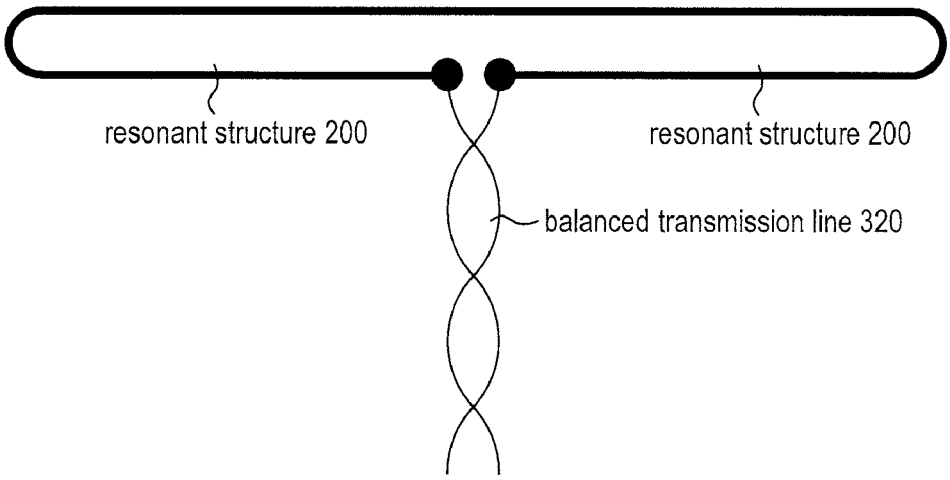
FIG. 3 PRIOR ART
FIG. 3 depicts a folded-dipole antenna in the prior art.
Figure 4:
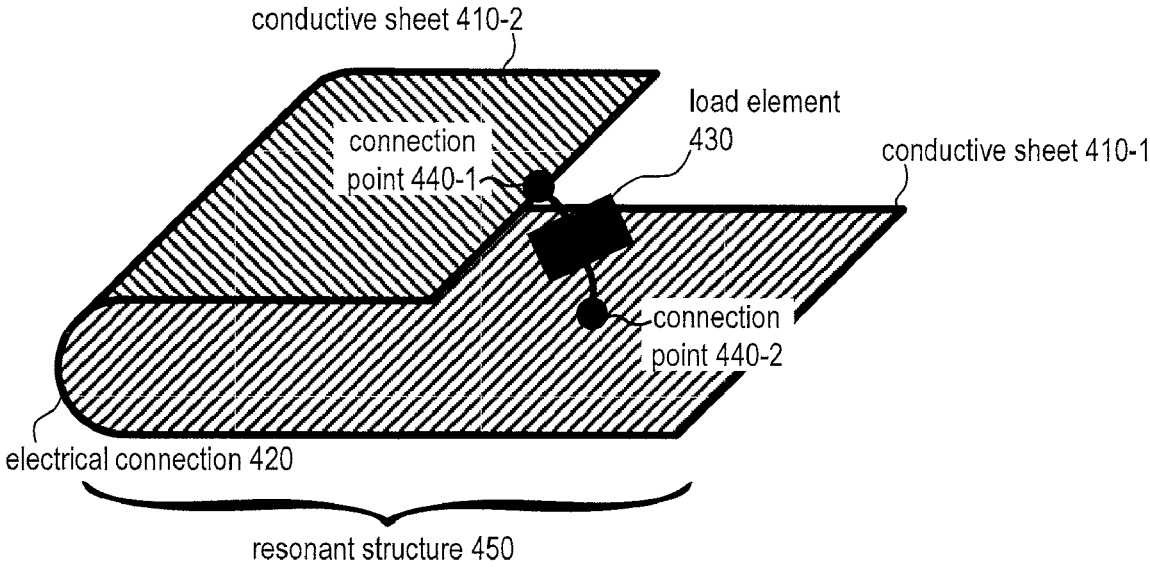
FIG. 4 PRIOR ART
FIG. 4 depicts an example of a type of antenna in the prior art for RFID tags.
Figure 5:
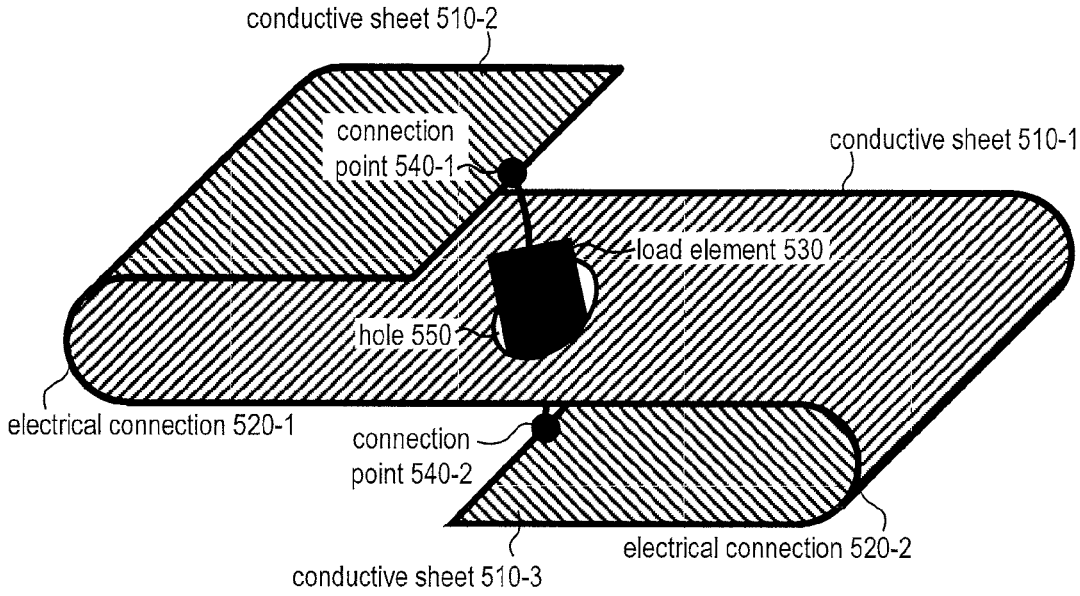
FIG. 5 depicts a dual-resonator antenna with a load element in accordance with a first illustrative embodiment of the present invention.

FIG. 5 depicts dual-resonator antenna with load element 500 in accordance with a first illustrative embodiment of the present invention. Dual-resonator antenna with load element 500 comprises: conductive sheets 510-1, 510-2, and 510-3, electrical connections 520-1 and 520-2, connection points 540-1 and 540-2, and load element 530, interrelated as shown. Conductive sheet 510-1 comprises hole 550 through which passes load element 530.

Conductive sheet 510-2 is substantially parallel to conductive sheet 510-2. These two sheets, together with electrical connection 520-1, form a first resonant structure similar to resonant structure 450. Conductive sheet 510-3 is substantially parallel to conductive sheet 510-2. These two sheets, together with electrical connection 520-1, form a second resonant structure similar to resonant structure 450. Conductive sheets 510-2 and 510-3 are on opposite sides of conductive sheet 510-1, so that the first and second resonant structures share conductive sheet 510-1. Because conductive sheet 510-1 is shared between the two resonant structures, it provides an electrical connection between the two structures whereby the two resonant structures are connected in series.

Connection point 540-1 is on the first resonant structure and connection point 540-2 is on the second resonant structure. When the antenna is used as a receiving antenna, the voltage between the two connection points (hereinafter the "output voltage") results from the two voltages generated by the two resonant structures (hereinafter the "resonant voltages") in response to an incident electromagnetic signal. Because the two resonant structures are connected in series, the output voltage is the algebraic sum of the resonant voltages.

The output voltage as a function of time is the electrical signal, $s_T$, that the antenna generates in response to the incident electromagnetic signal. The two resonant voltages as functions of time are the two signals, $s_1$ for the first resonant structure and $s_2$ for the second resonant structure, generated across each structure in response to the incident electromagnetic signal. These signals should be understood to be sinusoidal at a given frequency, the same for all of them. Accordingly, each signal is characterized by an amplitude and a phase. It is well known in the art how to relate a sinusoidal signal to its amplitude and phase; in particular, the amplitude of a signal, s, is max[|s|], where s can be $s_T$, $s_1$, or $s_2$.

In general, there is a phase difference between $s_1$ and $s_2$. The phase difference depends on the spatial characteristics of the incident electromagnetic signal. In particular, the phase difference can be analyzed for the specific case when the incident electromagnetic signal is a polarized plane wave. In such a case, the resulting phase shift can be measured as a function of the direction of arrival and the polarization of the plane wave. Because plane waves are a complete set within the vector space of electromagnetic signals (equivalent to spherical harmonics) this is a complete characterization of the antenna at the frequency of $s_T$, $s_1$, and $s_2$.

The subset of all possible directions of arrival and polarizations for which the amplitude of $s_T$ is larger than the amplitude of $s_1$ is denoted by $A_1$; i.e., $A_1$ is the subset for which $\max[|s_T|]>\max[|s_1|]$. The subset of all possible directions of arrival and polarizations for which the amplitude of $s_T$ is larger than the amplitude of $s_2$ is denoted by $A_2$; i.e., $A_2$ is the subset for which $\max[|s_T|]>\max[|s_2|]$. The intersection of these two subsets, $A_1 \cap A_2$, corresponds to the subset of all possible incident plane waves for which the phase shift is sufficiently small that the amplitude of $s_T$ is larger than the amplitude of either $s_1$ or $s_2$ individually. In such cases, the antenna, when used in an RFID tag, provides improved performance compared to an antenna that comprises only one or the other of the two resonant structures.

It is well known in the art how to measure the size of the $A_1 \cap A_2$ subset. In particular, directions of arrival correspond to points on the surface of a sphere and, therefore, a set of directions can be measured in units of steradians. Polarization states can also be represented as points on a sphere (for example, on the Poincaré sphere) and, therefore, a set of polarizations can also be measured. It is a characteristic of the first illustrative embodiment of FIG. 5 that the $A_1 \cap A_2$ subset comprises the majority (i.e., more than one-half) of all possible directions of arrival and polarizations when signals $s_T$, $s_1$, and $s_2$ have a frequency within the resonant bands of both resonant structures.

In the first illustrative embodiment, the two resonant structures have resonant bands that overlap over a common portion (hereinafter "common band"). For example, the two resonant structures can be identical in shape and, therefore, have the same resonant band. For electromagnetic signals at frequencies within the common band, the antenna of FIG. 5 provides a larger voltage, compared to an antenna that comprises only one or the other of the two resonant structures, for a majority of all possible directions of arrival and polarizations. Therefore, an RFID tag based on the antenna of FIG. 5 has, in most cases, an improved range.

Although FIG. 5 shows the conductive sheets as solid sheets of electrically conductive material, it will be clear to those skilled in the art, after reading this disclosure, how to make and use alternative embodiments of the present invention wherein the conductive sheets are not solid. For example, and without limitation, each of the conductive sheets can:

i. be a grid of wires, or a mesh, or
ii. be perforated with holes arranged at random or in a regular pattern, or
iii. be a printed circuit board with one or more interconnection layers,
iv. comprise notches or jagged edges,
v. have an uneven or rough surface with bumps or lumps, or
vi. comprise electronic components, such as, for example, resistors, capacitors or integrated circuits,
vii. comprise mechanical fasteners such as, for example, screws, nuts, or rivets, or
viii. comprise solder joints, welds or other electrical or mechanical joints, or
ix. be an array of parallel wires substantially parallel to the prevailing direction of electrical currents within the sheet.
x. be a combination of i, ii, iii, iv, v, vi, vii, viii, or ix.

Although the conductive sheets in FIG. 5 are depicted as rectangular in shape, it will be clear to those skilled in the art, after reading this disclosure, how to make and use alternative embodiments of the present invention wherein the conductive sheets have other shapes. It is well known in the art how to make resonant structures with a variety of alternative shapes. Such resonant structures can be combined in a manner equivalent to how the first resonant structure and the second resonant structure are combined in FIG. 5 to achieve alternative embodiments of the present invention.

Although electrical connections 520-1 and 520-2 are depicted in FIG. 5 as sections of conductive sheet material bent in semicircular shapes, it will be clear to those skilled in the art, after reading this disclosure, how to make and use alternative embodiments of the present invention wherein electrical connections between sheets are realized differently. For example and without limitation, electrical connections 520-1 and 520-2 can be:

i. single wires or multiple wires, or
ii. portions of sheet material bend in different shapes, or
iii. single or multiple connections at single or multiple points along the edges of the interconnected sheets, or
iv. solder joints, screws, pins, or other electrically conductive fasteners, or
v. plated-through via holes, or
vi. a combination of i, ii, iii, iv, or v.

Furthermore, the electrical connections can extend over larger or smaller sections of one or more edges of the conductive sheets.

Although the first resonant structure and the second resonant structure are connected in FIG. 5 by virtue of sharing conductive sheet 510-1, it will be clear to those skilled in the art, after reading this disclosure, how to make and use alternative embodiments of the present invention wherein the two resonant structures are electrically connected in other ways. For example and without limitation, the two resonant structures can be connected through:

i. single wires or multiple wires, or
ii. portions of sheet material, or
iii. solder joints, screws, pins, or other electrically conductive fasteners, or
iv. plated-through via holes, or
v. a combination of i, ii, iii, or iv.

Although connection points 540-1 and 540-2 are depicted in FIG. 5 as being placed near the center of the sheet edge on which they occur, and load element 530 goes through hole 550 near the center of sheet 510-1, it will be clear to those skilled in the art, after reading this disclosure, how to make and use alternative embodiments of the present invention wherein the connection points are in different places, and load element 530 is connected between sheets 510-2 and 510-3 in other ways. For example and without limitation, connection points 540-1 and 540-2 can be near corners of sheets 510-2 and 510-3, and load element 530 can pass around the side of sheet 510-1, or through a notch in the edge of sheet 510-1.

Figure 6:
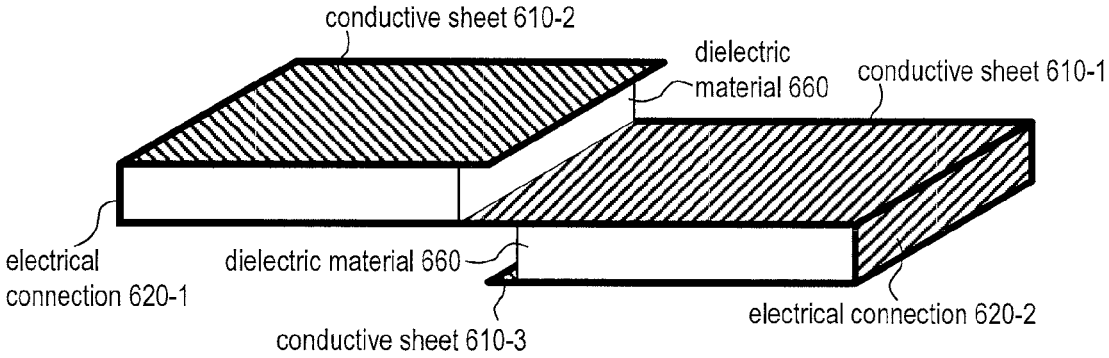
FIG. 6 depicts a dual-resonator antenna with a dielectric in accordance with a second illustrative embodiment of the present invention.

FIG. 6 depicts dual-resonator antenna with dielectric 600 in accordance with a second illustrative embodiment of the present invention. Dual-resonator antenna with dielectric 600 comprises: conductive sheets 610-1, 610-2, and 610-3, electrical connections 620-1 and 620-2, and dielectric material 660, interrelated as shown.

For the purpose of clarity, FIG. 6 does not show connection points, a load element or a hole in sheet 610-1. Such elements in the second illustrative embodiment are identical to the corresponding elements in the first illustrative embodiment and should be understood to be present even though they are not depicted in FIG. 6. The salient elements of the second illustrative embodiment that differ from the corresponding elements of the first illustrative embodiment are:

i. dielectric material 660 occupies part of the volumes of the two resonant structures, and
ii. electrical connections 620-1 and 620-2 are realized as sections of conductive sheet material bent at right angles.

Although dielectric material 660 is shown in FIG. 6 as occupying most of the volume between sheet 610-1 and sheets 610-2 and 610-3, it will be clear to those skilled in the art, after reading this disclosure, how to make and use alternative embodiments of the present invention wherein only a portion of the volume is occupied by dielectric material, or dielectric material extends beyond the volume between the conductive sheets. Furthermore, it will be clear to those skilled in the art, after reading this disclosure, how to make and use alternative embodiments of the present invention wherein more than one type of dielectric material is used, or wherein the two resonant structures comprise dielectric materials that are different or have different shapes.

Many different dielectric materials are known in the art for making resonant structures. For example, and without limitation, dielectric material 660 can be acetate, ABS (Acrylonitrile Butadiene Styrene) of various densities, polyphenylsulphone, polyethersulfone, polysulfone, PETG (Polyethylene Terephthalate Glycol), polycarbonate, teflon, polystyrene, or polyethylene.

Figure 7:
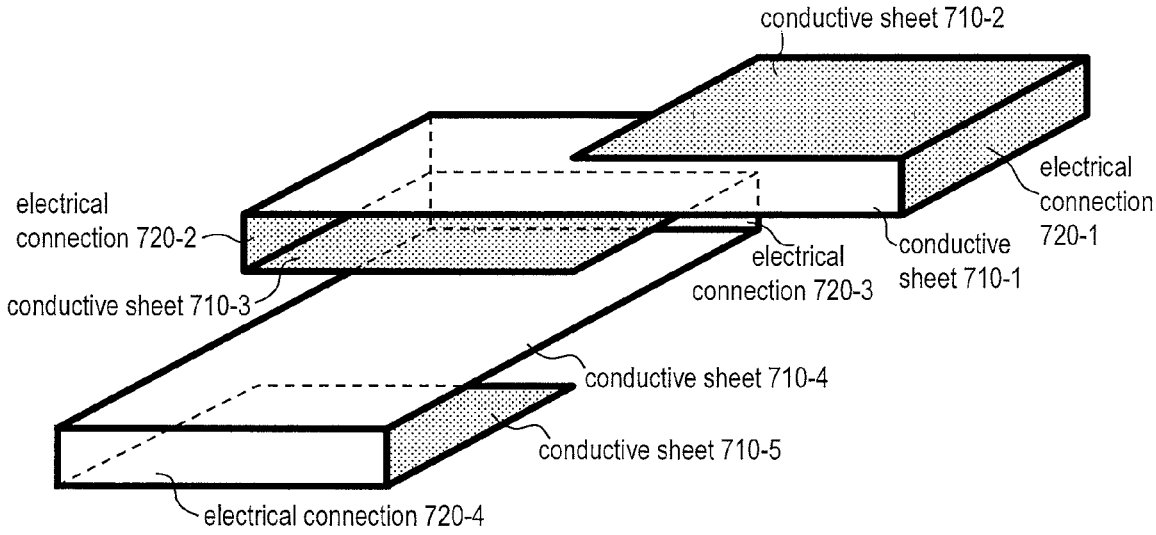
FIG. 7 depicts a multiple-resonator antenna in accordance with a third illustrative embodiment of the present invention.

FIG. 7 depicts multiple-resonator antenna 700 in accordance with a third illustrative embodiment of the present invention. Multiple-resonator antenna 700 comprises: conductive sheets 710-1, 710-2, 710-3, 710-4, and 710-5, and electrical connections 720-1, 720-2, 720-3, and 720-4, interrelated as shown.

For the purpose of clarity, FIG. 7 does not show connection points or a load element. Such elements are present in the third illustrative embodiment and are shown in FIG. 8.

The salient feature of the third illustrative embodiment is that the antenna comprises four resonant structures. In particular, conductive sheets 710-1 and 710-2, together with electrical connection 720-1, form a first resonant structure similar to resonant structure 450. Conductive sheets 710-1 and 710-3, together with electrical connection 720-2, form a second resonant structure similar to resonant structure 450. Conductive sheets 710-4 and 710-3, together with electrical connection 720-3, form a third resonant structure similar to resonant structure 450. Conductive sheets 710-4 and 710-5, together with electrical connection 720-4, form a fourth resonant structure similar to resonant structure 450.

The first and second resonant structures share conductive sheet 710-1; because conductive sheet 710-1 is shared between the two resonant structures, it provides an electrical connection between the two structures whereby the two resonant structures are connected in series. The second and third resonant structures share conductive sheet 710-3; because conductive sheet 710-3 is shared between the two resonant structures, it provides an electrical connection between the two structures whereby the two resonant structures are connected in series. The third and fourth resonant structures share conductive sheet 710-4; because conductive sheet 710-4 is shared between the two resonant structures, it provides an electrical connection between the two structures whereby the two resonant structures are connected in series.

Figure 8:
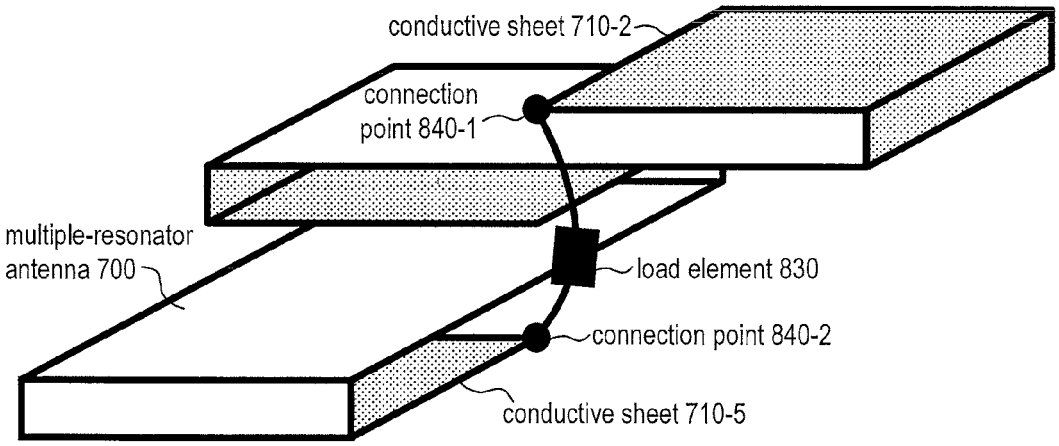
FIG. 8 depicts a multiple-resonator antenna with a load element in accordance with the third illustrative embodiment of the present invention.

Overall, the four resonant structures are connected in series and, as a result, the four signals produced by the four structures, $s_1$, $s_2$, $s_3$, and $s_4$, are added together to produce an overall signal, $s_T$, that can be applied to a load element, as shown in FIG. 8.

It will be clear to those skilled in the art, after reading this disclosure, how the comments presented for the first illustrative embodiment can be extended to the third illustrative embodiment. In particular, for each resonant structure, i, wherein i=1, 2, 3, 4, (for the first, second, third and fourth resonant structure, respectively) there is a subset, $A_i$, of all possible directions of arrival and polarizations for which max $[|s_T|]>\max[|s_i|]$. The intersection of these four subsets, $A_1 \cap A_2 \cap A_3 \cap A_4$, corresponds to the subset of all possible incident plane waves for which the phase shift is sufficiently small that the amplitude of $s_T$ is larger than the amplitude of $s_1$, $s_2$, $s_3$, or $s_4$ individually. In such cases, the antenna, when used in an RFID tag, provides improved performance compared to an antenna that comprises only one of the four resonant structures.

In the third illustrative embodiment, the four resonant structures have resonant bands that overlap over a common band. For electromagnetic signals at frequencies within the common band, the antenna of FIG. 7 provides a larger voltage, compared to an antenna that comprises only one resonant structures, for a majority of all possible directions of arrival and polarizations.

FIG. 8 depicts multiple-resonator antenna with load element 800 in accordance with the third illustrative embodiment of the present invention. Multiple-resonator antenna with load element 800 comprises: multiple-resonator antenna 700, load element 830 and connection points 840-1 and 840-2, interrelated as shown.

Load element 830 is connected to connection point 840-1 on conductive sheet 710-2 and to connection point 840-2 on conductive sheet 710-5, such that the voltage applied to load element 830 is the voltage resulting from the four resonant structures connected in series.

Although load element 830 is depicted as positioned around the edges of the conductive sheets, it will be clear to those skilled in the art, after reading this disclosure, how to make and use alternative embodiments of the present invention wherein load 830 is positioned differently. Furthermore, although the first, second and third illustrative embodiments comprise two or four resonant structures, it will be clear to those skilled in the art, after reading this disclosure, how to make and use alternative embodiments of the present invention with a different number of resonant structures, including, without limitation, three resonant structures or more than four resonant structures.

It is to be understood that this disclosure teaches just one or more examples of one or more illustrative embodiments, and that many variations of the invention can easily be devised by those skilled in the art after reading this disclosure, and that the scope of the present invention is to be determined by the following claims.

What is claimed is:

1. An antenna comprising:

a first electromagnetically-resonant structure with a first band of resonance;

a second electromagnetically-resonant structure with a second band of resonance;

a mechanical mount for maintaining the first structure in a fixed position relative to the second structure;

an electrical connection between the first structure and the second structure; and an input-output port comprising a first connection point on the first structure and a second connection point on the second structure;

wherein the input-output port is for connecting the antenna to a two-terminal load;

wherein one of the two terminals of the two-terminal load is connected to the first connection point, and the other terminal of the two-terminal load is connected to the second connection point;

wherein a portion of the first band of resonance and a portion of the second band of resonance overlap over a common band;

wherein the first electromagnetically-resonant structure and the second electromagnetically-resonant structure are connected in series for driving the two-terminal load;

wherein the antenna, in response to an electromagnetic signal within the common band, generates:

(i) a first electrical signal, $s_1$, across the first structure, between the first connection point and the electrical connection, (ii) a second electrical signal, $s_2$, across the second structure, between the second connection point and the electrical connection, (iii) a third electrical signal, $S_T$, between the first connection point and the second connection point;

wherein the amplitude of the third electrical signal, max $[|s_T|]$, is larger than the amplitude, max$[|s_1|]$, of the first electrical signal whenever the direction of arrival and the polarization of the electromagnetic signal fall within a first subset, $A_1$, of all possible directions of arrival and polarizations;

wherein the amplitude of the third electrical signal, max $[|s_T|]$, is larger than the amplitude, max$[|s_2|]$, of the second electrical signal whenever the direction of arrival and the polarization of the electromagnetic signal fall within a second subset, $A_2$, of all possible directions of arrivals and polarizations; and wherein the intersection of the first subset and the second subset, $A_1 \cap A_2$, comprises more than one-half of all possible directions of arrivals and polarizations.

2. The antenna of claim 1 wherein the mechanical mount comprises the electrical connection.

3. An antenna comprising:

a first electromagnetically-resonant structure with a first band of resonance;

a second electromagnetically-resonant structure with a second band of resonance;

a third electromagnetically-resonant structure with a third band of resonance;

a fourth electromagnetically-resonant structure with a fourth band of resonance;

a mechanical mount for maintaining the first, second, third and fourth, structure in a fixed position relative to one another;

a first electrical connection between the first structure and the second structure;

a second electrical connection between the second structure and the third structure;

a third electrical connection between the third structure and the fourth structure; and an input-output port comprising a first connection point on the first structure and a second connection point on the fourth structure;

wherein a portion of the first band of resonance, a portion of the second band of resonance, a portion of the third band of resonance, and a portion of the fourth band of resonance overlap over a common band;

wherein the antenna, in response to an electromagnetic signal within the common band, generates:

(i) a first electrical signal, $s_1$, across the first structure, between the first connection point and the first electrical connection, (ii) a second electrical signal, $s_2$, across the second structure, between the first electrical connection and the second electrical connection, (ii) a third electrical signal, $s_3$, across the third structure, between the second electrical connection and the third electrical connection, (iv) a fourth electrical signal, $s_4$, across the fourth structure, between the third electrical connection and the second connection point, (v) a fifth electrical signal, $S_T$, between the first connection point and the second connection point;

wherein the amplitude of the fifth electrical signal, max $[|s_T|]$, is larger than the amplitude, max$[|s_1|]$, of the first electrical signal whenever the direction of arrival and the polarization of the electromagnetic signal fall within a first subset, $A_1$, of all possible directions of arrival and polarizations;

wherein the amplitude of the fifth electrical signal, max $[|s_T|]$, is larger than the amplitude, max$[|s_2|]$, of the second electrical signal whenever the direction of arrival and the polarization of the electromagnetic signal fall within a second subset, $A_2$, of all possible directions of arrivals and polarizations;

wherein the amplitude of the fifth electrical signal, max $[|s_T|]$, is larger than the amplitude, max$[|s_3|]$, of the third electrical signal whenever the direction of arrival and the polarization of the electromagnetic signal fall within a third subset, $A_3$, of all possible directions of arrivals and polarizations;

wherein the amplitude of the fifth electrical signal, max $[|s_T|]$, is larger than the amplitude, max$[|s_4|]$, of the fourth electrical signal whenever the direction of arrival and the polarization of the electromagnetic signal fall within a fourth subset, $A_4$, of all possible directions of arrivals and polarizations; and wherein the intersection of the first, second, third, and fourth subsets, $A_1 \cap A_2 \cap A_3 \cap A_4$, comprises more than one-half of all possible directions of arrivals and polarizations.

4. The antenna of claim 3 wherein the mechanical mount comprises the first electrical connection, the second electrical connection, and the third electrical connection.

5. An antenna comprising:

a plurality of N electromagnetically-resonant structures, $E_i$, wherein i=1, . . . , N, and wherein each structure has a band of resonance $B_i$;

a mechanical mount for maintaining the structures in fixed positions relative to one another;

a plurality of N−1 electrical connections, $s_i$, wherein j=1, . . . , N−1, and wherein electrical connection $C_j$ is between structure $E_j$ and structure $E_{j+1}$, for j=1, . . . , N−1; and an input-output port comprising a first connection point on structure $E_1$, and a second connection point on structure $E_N$;

wherein the input-output port is for connecting the antenna to a two-terminal load;

wherein one of the two terminals of the two-terminal load is connected to the first connection point, and the other terminal of the two-terminal load is connected to the second connection point;

wherein each of the bands of resonance comprises a common band portion, $B_c$, that is the same for all bands;

wherein the N electromagnetically-resonant structures are connected in series for driving the two-terminal load;

wherein the antenna, in response to an electromagnetic signal within the common band, $B_c$, generates:

(i) a plurality of electrical signals, $s_i$, wherein i=1, . . . , N, and (a) signal $s_1$, is generated across structure $E_1$ between the first connection point and connection $C_1$, (b) signal $s_N$, is generated across structure $E_N$ between the second connection point and connection $C_{N-1}$, and (c) signal $s_k$, is generated across structure $E_k$ between connection $C_{k-1}$ and connection $C_k$, (ii) an output electrical signal, $s_T$, between the first connection point and the second connection point;

wherein the amplitude of the output electrical signal, max $[|s_T|]$, is larger than the amplitude, max$[|s_i|]$, of electrical signal $s_i$ whenever the direction of arrival and the polarization of the electromagnetic signal fall within a subset, $A_i$, of all possible directions of arrival and polarizations, wherein i=1, . . . , N;

wherein the intersection of the subsets $A_1, \ldots, A_N$, denoted as $$\bigcap_{i=1}^{N} A_i = A_1 \cap \ldots \cap A_N,$$

comprises more than one-half of all possible directions of arrivals and polarizations.

6. An apparatus comprising:

a first sheet of conductive material;

a second sheet of conductive material substantially parallel to the first sheet;

a third sheet of conductive material substantially parallel to the first sheet;

a first electrical connection between a portion of the edge of the second sheet and the first sheet;

a second electrical connection between a portion of the edge of the third sheet and the first sheet; and an input-output port comprising a first connection point on the second sheet and a second connection point on the third sheet;

wherein the first sheet is between the second sheet and the third sheet;

wherein the outline shape of the second sheet is substantially within the outline shape of the first sheet;

wherein the outline shape of the third sheet is substantially within the outline shape of the first sheet;

wherein the input-output port is for connecting the apparatus to a two-terminal load; and wherein the second sheet, the first sheet, and the third sheet are connected in series for driving the two-terminal load.

7. The apparatus of claim 6 wherein the first sheet is substantially rectangular in shape.

8. The apparatus of claim 6 wherein a load element is connected between the first connection point and the second connection point.

9. The apparatus of claim 8 wherein the load element comprises a rectifier for rectifying an electrical radiofrequency signal.

10. The apparatus of claim 6 wherein the volume of space between the first sheet and the second sheet comprises a dielectric material.

11. An apparatus comprising:

a first sheet of conductive material;

a second sheet of conductive material substantially parallel to the first sheet, at a distance from the first sheet that is less than the longest dimension of the first sheet;

a third sheet of conductive material substantially parallel to the first sheet, at a distance from the first sheet that is less than the longest dimension of the first sheet;

a fourth sheet of conductive material substantially parallel to the third sheet, at a distance from the third sheet that is less than the longest dimension of the first sheet;

a fifth sheet of conductive material substantially parallel to the fourth sheet, at a distance from the fourth sheet that is less than the longest dimension of the first sheet;

a first electrical connection between a portion of the edge of the second sheet and the first sheet;

a second electrical connection between a portion of the edge of the third sheet and the first sheet; and a third electrical connection between a portion of the edge of the third sheet and the fourth sheet; and a fourth electrical connection between a portion of the edge of the fifth sheet and the fourth sheet; and an input-output port comprising a first connection point on the second sheet and a second connection point on the fifth sheet;

wherein the first sheet is between the second sheet and the third sheet, the third sheet is between the first sheet and the fourth sheet, and the fourth sheet is between the third sheet and the fifth sheet.

12. The apparatus of claim 11 wherein the first sheet is substantially rectangular in shape, and the fourth sheet is substantially rectangular in shape.

13. The apparatus of claim 12 wherein the long dimension of the first sheet and the long dimension of the fourth sheet are substantially orthogonal.

14. The apparatus of claim 11 wherein a load element is connected between the first connection point and the second connection point.

15. The apparatus of claim 14 wherein the load element comprises a rectifier for rectifying an electrical radiofrequency signal.

16. The apparatus of claim 15 wherein the volume of space between the first sheet and the second sheet comprises a dielectric material.

* * * * *